US010737836B2

(12) United States Patent
Carpenter

(10) Patent No.: US 10,737,836 B2
(45) Date of Patent: Aug. 11, 2020

(54) BOTTLE MOUNTING METHODS AND SYSTEMS

(71) Applicant: William B. Carpenter, Squamish (CA)

(72) Inventor: William B. Carpenter, Squamish (CA)

( * ) Notice: Subject to any disclaimer, the term of this patent is extended or adjusted under 35 U.S.C. 154(b) by 0 days.

(21) Appl. No.: 15/767,130

(22) PCT Filed: Oct. 7, 2016

(86) PCT No.: PCT/CA2016/051172

§ 371 (c)(1),
(2) Date: Apr. 9, 2018

(87) PCT Pub. No.: WO2017/059543

PCT Pub. Date: Apr. 13, 2017

(65) Prior Publication Data

US 2019/0071216 A1 Mar. 7, 2019

Related U.S. Application Data

(60) Provisional application No. 62/239,580, filed on Oct. 9, 2015.

(51) Int. Cl.
*B65D 23/06* (2006.01)
*B65D 23/12* (2006.01)

(52) U.S. Cl.
CPC ..... *B65D 23/065* (2013.01); *B65D 23/12* (2013.01); *B65D 2203/06* (2013.01); *B65D 2203/10* (2013.01); *B65D 2203/12* (2013.01); *B65D 2211/00* (2013.01)

(58) Field of Classification Search
CPC .. B65D 23/065; B65D 23/12; B65D 2211/00; B65D 2203/12; B65D 2203/06; B65D 2203/10
USPC ..... 248/312, 313, 314; 211/74, 75, 76
See application file for complete search history.

(56) References Cited

U.S. PATENT DOCUMENTS

| | | | |
|---|---|---|---|
| 583,727 | A | 6/1897 | Braun |
| 632,321 | A | 9/1899 | Olney |
| 1,084,243 | A | 1/1914 | Young |
| 1,891,099 | A | 12/1932 | Land |
| 1,937,295 | A | 11/1933 | Rettenmeyer |
| 2,051,408 | A | 8/1936 | Karst |

(Continued)

FOREIGN PATENT DOCUMENTS

| | | | |
|---|---|---|---|
| AU | 31578/97 | A | 2/1999 |
| CA | 2677021 | A1 | 2/2010 |

(Continued)

OTHER PUBLICATIONS

Australian Intellectual Property Office, "Examination report No. 2 for standard patent application", in connection with related Australian Patent App. No. 2013308027, dated Nov. 8, 2018, 3 pages.

(Continued)

*Primary Examiner* — Muhammad Ijaz
(74) *Attorney, Agent, or Firm* — Kolisch Hartwell, P.C.

(57) ABSTRACT

A method of mounting a bottle involves attaching, to a support body, an interface body attached to a portion of the bottle, such that at least a portion of the interface body and the portion of the bottle are positioned within an aperture defined by the support body. Bottle mounting systems are also disclosed.

30 Claims, 15 Drawing Sheets

(56) References Cited

U.S. PATENT DOCUMENTS

| | | | | |
|---|---|---|---|---|
| 2,327,379 | A | 8/1943 | Thomas | |
| 2,527,796 | A | 10/1950 | Clute | |
| 3,339,814 | A | 9/1967 | Carbine | |
| 3,461,769 | A | 8/1969 | Brosseit | |
| 3,478,457 | A | 11/1969 | Watkins | |
| D232,284 | S | 8/1974 | Shuck | |
| 3,901,389 | A | 8/1975 | Belokin, Jr. | |
| D236,565 | S | 9/1975 | Fuller | |
| D260,463 | S | 9/1981 | Imus | |
| 4,310,273 | A | 1/1982 | Kirrish | |
| 4,482,065 | A | 11/1984 | Altemose | |
| 4,494,788 | A | 1/1985 | Altemose | |
| 4,496,124 | A * | 1/1985 | Cole | A47G 23/0241 211/74 |
| D284,720 | S | 7/1986 | Watson | |
| D295,128 | S | 4/1988 | Gentile | |
| 4,787,591 | A | 11/1988 | Villacorta | |
| 4,819,815 | A | 4/1989 | Tarlow et al. | |
| 4,887,726 | A | 12/1989 | Cizaire | |
| 4,944,415 | A | 7/1990 | Orbach | |
| 5,025,936 | A | 6/1991 | Lamoureaux | |
| 5,098,241 | A | 3/1992 | Aldridge et al. | |
| 5,499,724 | A | 3/1996 | Hickman | |
| 5,503,276 | A | 4/1996 | Pierce | |
| 5,785,187 | A | 7/1998 | Lipman et al. | |
| 5,813,550 | A | 9/1998 | Sheehan et al. | |
| 5,865,326 | A | 2/1999 | Spamer et al. | |
| 5,890,635 | A * | 4/1999 | Wu | A45F 3/14 215/395 |
| 6,119,875 | A | 9/2000 | Smith | |
| 6,230,905 | B1 * | 5/2001 | Camblor | A47B 73/004 211/74 |
| 6,244,554 | B1 | 6/2001 | Baker | |
| D460,295 | S | 7/2002 | Fissell et al. | |
| D460,902 | S | 7/2002 | Battle | |
| 6,442,906 | B1 | 9/2002 | Hwang | |
| 6,631,813 | B1 | 10/2003 | Walter et al. | |
| 6,729,481 | B1 | 5/2004 | O'Brien | |
| 6,763,956 | B2 | 7/2004 | Woods | |
| D497,526 | S | 10/2004 | Sanders et al. | |
| 6,837,472 | B1 * | 1/2005 | Beutz | A45F 3/16 224/148.4 |
| 6,991,117 | B2 | 1/2006 | McCain | |
| 7,284,734 | B2 | 10/2007 | Hamerski | |
| 7,322,482 | B2 | 1/2008 | Caradonna | |
| 7,377,397 | B2 | 5/2008 | Lee et al. | |
| 7,673,761 | B2 | 3/2010 | Lee et al. | |
| 7,850,017 | B2 | 12/2010 | McCain | |
| 7,882,967 | B2 | 2/2011 | Hynes | |
| D634,992 | S | 3/2011 | McNamee | |
| D655,986 | S | 3/2012 | Schneider | |
| 8,231,015 | B2 | 7/2012 | McCain | |
| 8,267,259 | B2 * | 9/2012 | Fisher | A47B 73/004 211/75 |
| 8,267,326 | B2 * | 9/2012 | Kolton | B65D 23/14 235/492 |
| 8,573,548 | B2 | 11/2013 | Kuhn et al. | |
| D708,494 | S | 7/2014 | Carpenter | |
| 8,869,997 | B2 | 10/2014 | Collini | |
| D731,866 | S | 6/2015 | Paulick | |
| D735,540 | S | 8/2015 | Carpenter | |
| D739,189 | S | 9/2015 | Carpenter | |
| D739,190 | S | 9/2015 | Kasza et al. | |
| 9,149,115 | B2 | 10/2015 | Kasza et al. | |
| 9,565,933 | B2 | 2/2017 | Kasza et al. | |
| D785,418 | S | 5/2017 | Carpenter | |
| 2001/0013567 | A1 | 8/2001 | Valiulis | |
| 2004/0069730 | A1 | 4/2004 | Woods | |
| 2006/0065612 | A1 | 3/2006 | Gonneville | |
| 2007/0158284 | A1 | 7/2007 | Felder | |
| 2010/0051769 | A1 | 3/2010 | Tyson | |
| 2011/0132853 | A1 | 6/2011 | Drobot et al. | |
| 2011/0309220 | A1 | 12/2011 | Collini | |
| 2012/0085721 | A1 | 4/2012 | Michael J. et al. | |
| 2013/0200014 | A1 | 8/2013 | Canete Schlatter | |
| 2013/0334155 | A1 | 12/2013 | Kasza et al. | |
| 2016/0029790 | A1 | 2/2016 | Carpenter | |
| 2016/0331131 | A1 | 11/2016 | Ghaeni | |
| 2017/0105522 | A1 | 4/2017 | Kasza et al. | |
| 2019/0071216 | A1 * | 3/2019 | Carpenter | B65D 23/065 |

FOREIGN PATENT DOCUMENTS

| | | | |
|---|---|---|---|
| CA | 2743948 | A1 | 5/2010 |
| DE | 202004018406 | U1 | 1/2005 |
| DE | 102015101787 | A1 | 8/2016 |
| FR | 2327743 | A1 | 5/1977 |
| FR | 2456673 | A1 | 12/1980 |
| GB | 1202519 | A | 8/1970 |
| GB | 2122876 | A | 1/1984 |
| GB | 2189387 | A | 10/1987 |
| GB | 2242352 | A | 10/1991 |
| JP | 2013542769 | A | 11/2013 |
| KR | 101466012 | B1 | 11/2014 |
| WO | 2014032158 | A1 | 3/2014 |
| WO | 2017059543 | A1 | 4/2017 |

OTHER PUBLICATIONS

Australian Intellectual Property Office, "Examination report No. 1 for standard patent application" in connection with Australian Patent Application No. 2013308027, dated Nov. 28, 2017, 6 pages.

Cardamore, Heather, Authorized Office, Canadian Intellectual Property Office, "International Search Report" in connection with related PCT Patent App. No. PCT/CA2013/000259, dated Dec. 23, 2013, 2 pages.

Email from Mr. Carpenter to Mr. Kasza dated May 26, 2011 discussing ESIGO 4 wine rack design, 1 page.

ESIGO catalog, http://pdf.archiexpo.com/pdfiesigo-srliesigo-collection-201 I/63264-66039-_6.html, 2011, 10 pages.

Federal Court of Canada, "Statement of Claim" in connection with *Stact Wine Displays Inc.* v. *William B. Carpenter*, May 14, 2015, 11 pages.

Genuwine Cellars, Label Link (retrieved from http://www.genuwinecellars.com/metal-series/label-link) on Jan. 25, 2013), 6 pages.

Genuwine Cellars, Metal Series (retrieved from http://www.genuwinecellars.com/metal-series) on Feb. 21, 2013), 6 pages.

Genuwine Cellars, Peg System (retrieved from http://www.genuwinecellars.com/metal-series/peg-system/ on Jan. 25, 2013),6 pages.

Genuwine Cellars, proprietary material dated 2009, 2010 and 2012, 7 pages.

Hanham, Tanya, Authorized Officer, Canadian Intellectual Property Office, "International Search Report" in connection with related International App. No. PCT/CA2016/051172, dated Feb. 2, 2017, 3 pages.

Houzz Inc., Bachus Bottle Rack—modem—wine racks—by Made in Design, 2013 (retrieved from http://www.houzz.com/photos/151858/Bachus-Bottle-Rack-modem-wine-racks- on Jul. 18, 2013), 2 pages.

Houzz Inc., Live-Edge Solid Walnut 6-Bottle Wine Rack—eclectic—wine racks—by Etsy, 2013 (retrieved from http://www.houzz.com/photos/2739502/Live-Edge-Solid-Walnut-6-Bottle-Wine-Rack-eclectic-wine-racks-on Jul. 18, 2013), 11 pages.

Houzz Inc., Wood & Metal Industrial Wine Rack—contemporary—wine racks—by World Market, 2013 (retrieved from hittp://www.houzz.com/photos/1548374/Wood---Metal-Industrial-Wine-Rack-contemporary-wine-racks- on Jul. 18, 2013), 2 pages.

Norskor Olsen APS web page http://noerskovolsen.dk/billeder.htm, accessed on May 14, 2015, wine rack design published in 2004, 2 pages.

Photo of a wine cellar which appeared at web page http://www.houzz.com/photos/36895/Modern-Wine-Cellar-contemporary-wine-cellar-other-metro at least as early as Mar. 2011.

Photo of a wine cellar which appeared at web page http://www.houzz.com/photos/502220/Modern-Wine-Cellar-modern-wine-cellartoronto at least as early as Jan. 2012.

(56) References Cited

OTHER PUBLICATIONS

Stact Wine Displays Inc., Stact revolutionary wine rack, 2013 (retrieved from http://www.getstact.com/collections/wine-rack-revolutionized on Jul. 18, 2013) 3 pages.
Vin De Garde Cellar Systems, Modern Wine Cellars Catalog 2011, 2011, 12 pages.
WikiHow, "How to Hang Wall Cabinets" (https://web.archive.org/web/20120414004625/https://www.wikihow.com/Hang-Wall-Cabinets), retrieved on Nov. 22, 2017, published on Apr. 14, 2012 as per Wayback Machine, 3 pages.
William B. Carpenter, photo of wine cellar dated Jan. 28, 2012.

* cited by examiner

BOTTLE MOUNTING METHODS AND SYSTEMS

CROSS-REFERENCE TO RELATED APPLICATION

This application claims the benefit of, and priority to, U.S. provisional patent application No. 62/239,580 filed Oct. 9, 2015, the entire contents of which one incorporated by reference herein.

FIELD

This disclosure relates generally to methods and systems for mounting a bottle.

SUMMARY

According to one embodiment, there is disclosed a method of mounting a bottle, the method comprising attaching, to a support body, an interface body attached to a portion of the bottle, such that at least a portion of the interface body and the portion of the bottle are positioned within an aperture defined by the support body.

In some embodiments, the method further comprises detaching the interface body from the support body while the interface body remains attached to the portion of the bottle.

In some embodiments, detaching the interface body from the support body comprises actuating at least one actuator on the support body.

In some embodiments, detaching the interface body from the support body comprises disengaging at least one retaining body on the interface body from a respective at least one retaining surface of the support body.

In some embodiments, disengaging the at least one retaining body from the respective at least one retaining surface comprises radially repositioning the at least one retaining body to separate the at least one retaining body from the respective at least one retaining surface.

In some embodiments, disengaging the at least one retaining body from the respective at least one retaining surface comprises removing a portion of the at least one retaining body from a respective at least one opening defined by the support body and extending from the aperture of the support body to an outer surface of the support body.

In some embodiments, the portion of the bottle is attached to the interface body in an aperture defined by the interface body.

In some embodiments, the method further comprises attaching the interface body to the portion of the bottle.

In some embodiments, attaching the interface body to the portion of the bottle comprises frictionally engaging at least one attachment body of the interface body with a surface on the portion of the bottle.

In some embodiments, frictionally engaging the at least one attachment body of the interface body with the portion of the bottle comprises fixing the at least one attachment body in a fixed position against the surface on the portion of the bottle.

In some embodiments, fixing the at least one attachment body in the fixed position comprises fixing the at least one attachment body in the fixed position independently of the support body and independently of gravitational forces on the bottle.

In some embodiments, fixing the at least one attachment body in the fixed position comprises rotating a threaded body coupled to the at least one attachment body to position the at least one attachment body in the fixed position.

In some embodiments, the portion of the bottle comprises a portion of a neck of a wine bottle.

According to another embodiment, there is disclosed a bottle mounting system comprising an interface body comprising: a first attaching means for attaching the interface body to a portion of the bottle; and a second attaching means for attaching the interface body to a support body when at least a portion of the interface body and the portion of the bottle are positioned within an aperture defined by the support body and after the first attaching means is attached to the portion of the bottle.

In some embodiments, the system further comprises the support body. In some embodiments, the support body comprises a third attaching means complementary to the second attaching means for attaching the interface body to the support body when the at least a portion of the interface body and the portion of the bottle are positioned within the aperture of the support body and after the first attaching means is attached to the portion of the bottle.

According to another embodiment, there is disclosed a bottle mounting system comprising an interface body comprising: a clamp attachable to a portion of a bottle; and a first attachment surface attachable to a support body when at least a portion of the interface body and the portion of the bottle are positioned within an aperture defined by the support body and after the clamp is attached to the portion of the bottle.

In some embodiments, the system further comprises the support body. In some embodiments, the support body comprises a second attachment surface attachable to the first attachment surface to attach the interface body to the support body when the at least a portion of the interface body and the portion of the bottle are positioned within the aperture defined by the support body and after the clamp is attached to the portion of the bottle.

In some embodiments, the interface body is detachable from the support body while the interface body remains attached to the portion of the bottle.

In some embodiments, the support body comprises at least one actuator actuatable to detach the interface body from the support body.

In some embodiments, the interface body comprises a retaining body having the first attachment surface and resiliently movable from a deployed position, in which the first attachment surface is positioned to contact the second attachment surface to attach the interface body to the support body when the at least a portion of the interface body is positioned within the aperture of the support body, to a retracted position in which the first attachment surface is positioned to be separated from the second attachment surface when the at least a portion of the interface body is positioned within the aperture of the support body.

In some embodiments, the second attachment surface defines at least part of an opening extending from the aperture of the support body to an outer surface of the support body and positioned to receive a portion of the retaining body when the at least a portion of the interface body is positioned within the aperture of the support body.

In some embodiments, the retaining body is resiliently movable from the deployed position to the retracted position in a direction generally parallel to a longitudinal axis of the retaining body.

In some embodiments, the interface body comprises a generally annular body. In some embodiments, the retaining body is resiliently movable from the deployed position to the retracted position in a generally radial direction relative to the generally annular body.

In some embodiments, the interface body defines an aperture. In some embodiments, the clamp is positioned to attach to the portion of the bottle in the aperture of the interface body.

In some embodiments, the clamp comprises at least one attachment body frictionally engageable with a surface on the portion of the bottle.

In some embodiments, the at least one attachment body is fixedly positionable in a fixed position against the surface on the portion of the bottle.

In some embodiments, the at least one attachment body is fixedly positionable in the fixed position independently of the support body and independently of gravitational forces on the bottle.

In some embodiments, the interface body comprises a threaded body coupled to the at least one attachment body and rotatable to position the at least one attachment body in the fixed position.

In some embodiments, the interface body comprises a generally annular body that surrounds the portion of the bottle when the clamp is attached to the portion of the bottle.

In some embodiments, the clamp is sized to attach to a portion of a neck of a wine bottle.

Other aspects and features will become apparent to those ordinarily skilled in the art upon review of the following description of illustrative embodiments in conjunction with the accompanying figures.

DETAILED DESCRIPTION

Figure 1:
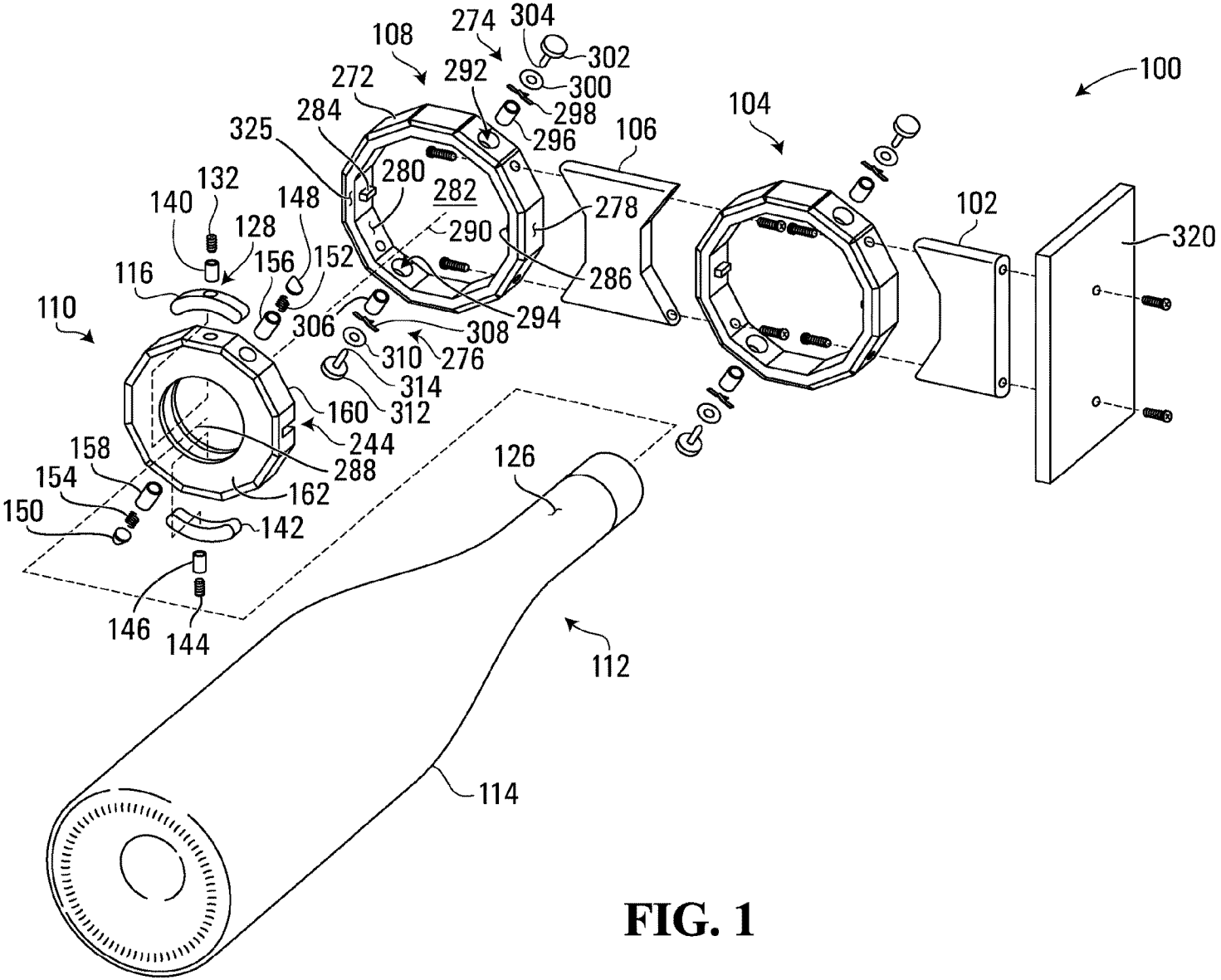
FIG. 1 is an exploded perspective view of a bottle mounting system according to one embodiment.

Referring to FIG. 1, a bottle mounting system according to one embodiment is shown generally at 100 and includes a rack body 102, a support body shown generally at 104, a rack body 106, a support body shown generally at 108, and an interface body shown generally at 110. The interface body 110 is configured to be attached to a portion of a bottle, and more specifically in the embodiment shown to a portion of a neck shown generally at 112 of a wine bottle 114, as described below. In alternative embodiments, the interface body 110 may be configured to be attached to other portions or to the entire wine bottle 114. Further, the wine bottle 114 is an example only, and in alternative embodiments, interface bodies may be attached to other bottles or containers, for example.

Figure 3:
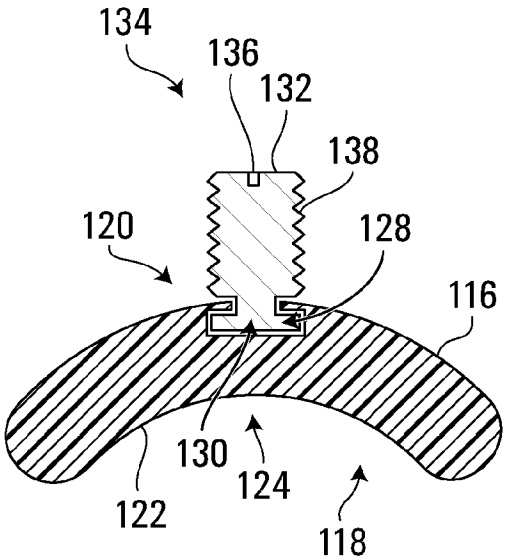
FIG. 3 is a cross-sectional view of the attachment body and the threaded body FIG. 2, taken along the line III-III in FIG. 2.
Figure 2:
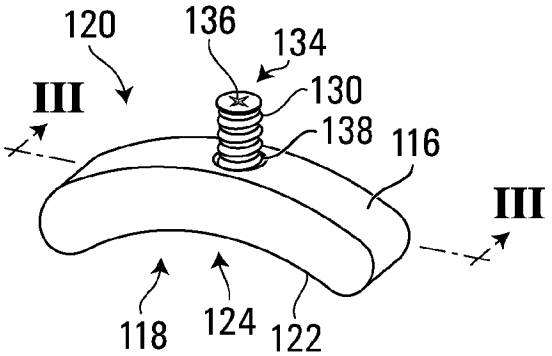
FIG. 2 is a perspective view of an attachment body and a threaded body of the bottle mounting system of FIG. 1.

Referring to FIGS. 1-3, the interface body 110 includes an attachment body 116 having an inner bottle-contacting side shown generally at 118, and an outer side shown generally at 120 and opposite the inner bottle-contacting side 118. On the inner bottle-contacting side 118, the attachment body 116 defines a bottle-contacting surface 122, which in the embodiment shown is generally arcuate and defines a recess shown generally at 124 to receive a portion of the neck 112 when an outer surface 126 of the neck 112 contacts the bottle-contacting surface 122 as described below. In this context, "generally arcuate" refers to a structure that may not be perfectly arcuate, but that may function the same as or substantially the same as an arcuate structure. More generally, "generally" herein includes variations to an applicable aspect, embodiment, or component described herein that may function the same as or substantially the same as such applicable aspect, embodiment, or component (as the case may be) described herein.

On the outer side 120, the attachment body 116 defines an aperture shown generally at 128 that receives a portion of an inner end shown generally at 130 of a threaded body 132. The inner end 130 is rotatably coupled to the outer side 120 of the attachment body 116. At an outer end shown generally at 134 and opposite the inner end 130, the threaded body defines a tool interface 136 to receive a torque from a tool (not shown) to rotate the threaded body 132 relative to the attachment body 116 while the threaded body 132 remains coupled to the attachment body 116. Between the inner end 130 and the outer end 134, the threaded body 132 defines external threads 138, which are complementary to internal threads (shown in FIGS. 6-8) of a threaded insert 140.

The interface body 110 also includes an attachment body 142, a threaded body 144, and a threaded insert 146, which are substantially the same as the attachment body 116, the threaded body 132, and the threaded insert 140 respectively. The interface body 110 also includes retaining bodies 148 and 150, springs 152 and 154, and guide bodies 156 and 158, all of which may be assembled in the interface body 110 as described below.

Figure 4:
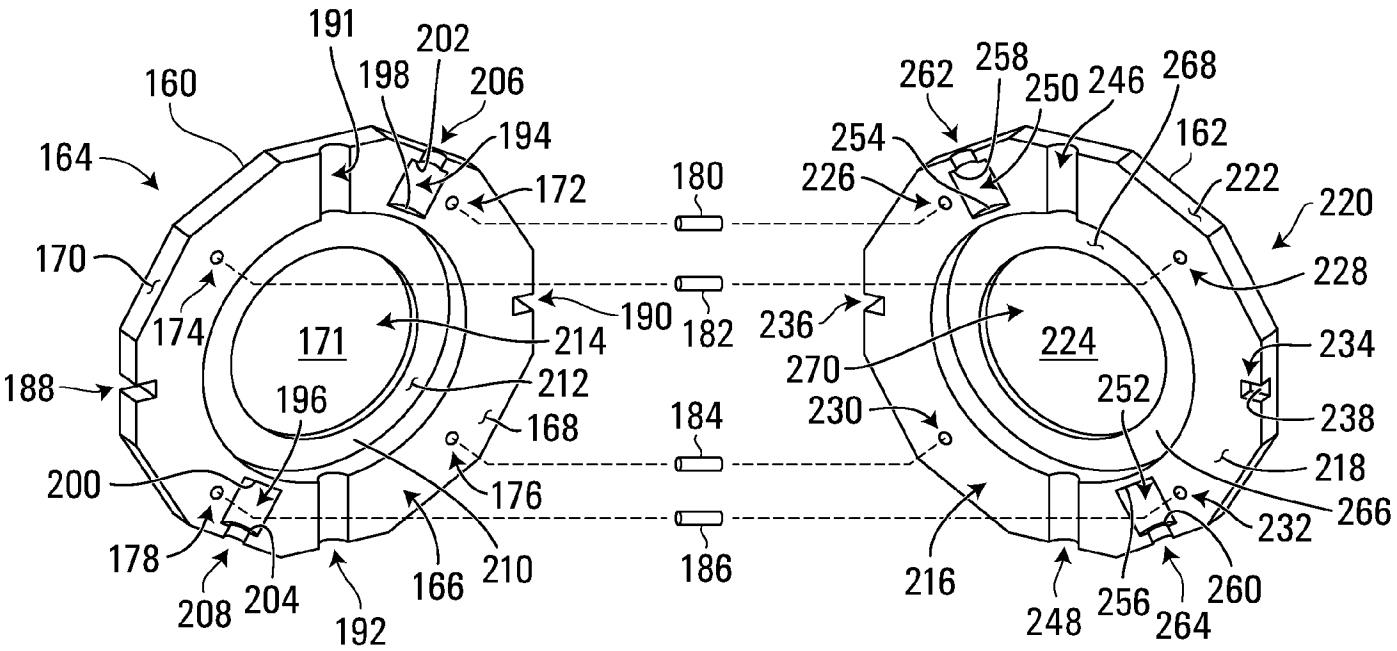
FIG. 4 is an exploded perspective view of front and rear interface body portions of a generally annular body of an interface body of the bottle mounting system of FIG. 1.
Figure 5:
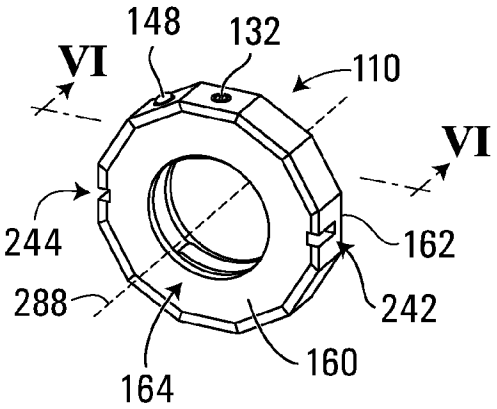
FIG. 5 is an assembled perspective view of the interface body of FIG. 4.
Figure 6:
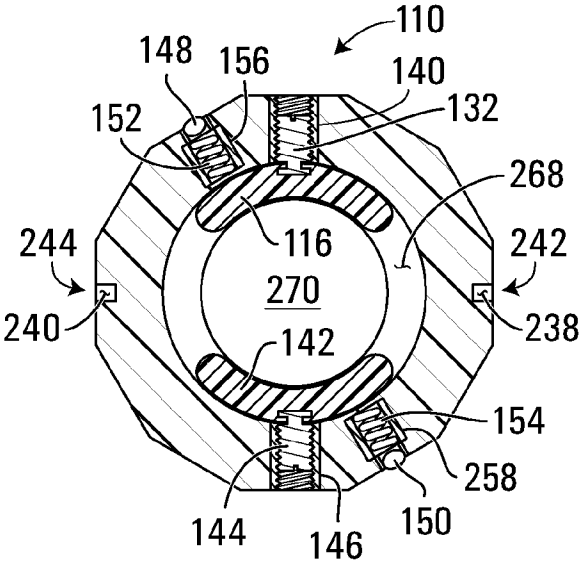
FIG. 6 is a cross-sectional view of the interface body of FIG. 4, taken along the line VI-VI in FIG. 5.

Referring to FIGS. 4-6, the interface body 110 may be assembled by assembling the attachment bodies 116 and 142, the threaded bodies 132 and 144, the threaded inserts 140 and 146, the retaining bodies 148 and 150, the springs 152 and 154, and the guide bodies 156 and 158 between a front interface body portion 160 and a rear interface body portion 162.

The front interface body portion 160 has a front side shown generally at 164, a rear side shown generally at 166, and a rear surface 168 on the rear side 166. Between the front side 164 and the rear side 166, the front interface body portion 160 has a peripheral outer surface 170 and a central aperture shown generally at 171. The front interface body portion 160 thus surrounds the aperture 171 and is thus generally annular.

On the rear side 166, the front interface body portion 160 defines generally cylindrical apertures shown generally at 172, 174, 176, and 178, which are sized to receive respective portions of generally cylindrical alignment bodies 180, 182, 184, and 186 respectively. The front interface body portion 160 also defines recesses shown generally at 188 and 190, each extending generally radially inward from the peripheral outer surface 170 on diametrically opposed sides of the front interface body portion 160, and each extending between the front side 164 and the rear side 166.

The front interface body portion 160 also defines generally semi-cylindrical recesses shown generally at 191 and 192, each recessed in the rear surface 168, each extending between the peripheral outer surface 170 and the aperture 171, and each sized to receive a portion of the threaded inserts 140 and 146 respectively.

The front interface body portion 160 also defines generally semi-cylindrical recesses shown generally at 194 and 196, each recessed in the rear surface 168, and each spaced apart from the peripheral outer surface 170 and from the aperture 171 such that the recesses 194 and 196 terminate at radially inward end surfaces 198 and 200 respectively and at radially outward end surfaces 202 and 204 respectively. The front interface body portion 160 defines generally semi-circular openings shown generally at 206 and 208, each extending between the peripheral outer surface 170 and the end surfaces 202 and 204 respectively such that the recesses 194 and 196 are open through the openings 206 and 208 and thus through the peripheral outer surface 170.

The front interface body portion 160 also includes a generally annular wall 210 on the front side 164 of the front interface body portion 160 and in the aperture 171, and the generally annular wall 210 includes a rear-facing surface 212 facing towards the rear side 166 of the front interface body portion 160 in the aperture 171. The rear surface 168 and the rear-facing surface 212 are spaced apart by an axial distance of about half of a width of the attachment bodies 116 and 142 to receive about half of the attachment bodies 116 and 142 in a space between the rear surface 168 and the rear-facing surface 212. A through-opening shown generally at 214 in the generally annular wall 210 has a diameter large enough to receive the neck 112. For example, the diameter of the through-opening 214 may be between about 20 millimeters ("mm") and about 25 mm.

The rear interface body portion 162 has a front side shown generally at 216, a front surface 218 on the front side 216, and a rear side shown generally at 220. Between the front side 216 and the rear side 220, the rear interface body portion 162 has a peripheral outer surface 222 and a central aperture shown generally at 224. The rear interface body portion 162 thus surrounds the aperture 224 and is thus generally annular.

On the front side 216, the rear interface body portion 162 defines generally cylindrical apertures shown generally at 226, 228, 230, and 232, which are sized to receive respective portions of the alignment bodies 180, 182, 184, and 186 respectively. The rear interface body portion 162 also defines recesses shown generally at 234 and 236, each extending generally radially inward from the peripheral outer surface 222 on diametrically opposed sides of the rear interface body portion 162, and each recessed in the front surface 218. However, the recesses 234 and 236 do not extend to the rear side 220 of the rear interface body portion 162. Rather, the recess 234 terminates axially at an end surface 238, and the recess 236 terminates axially at an end surface 240.

Further, the recesses 234 and 236 are aligned with the recesses 188 and 190 respectively such that when the rear surface 168 of the front interface body potion 160 is fastened (by adhesive, for example) to the front surface 218 of the rear interface body portion 162 with portions of the alignment bodies 180, 182, 184, and 186 received in the apertures 172, 174, 176, and 178 respectively and in the apertures 226, 228, 230, and 232 respectively, the front interface body portion 160 and the rear interface body portion 162 collectively define a generally annular body, the recesses 188 and 234 collectively define a recess shown generally at 242 and open to the front side 164 and terminating at the end surface 238, and the recesses 190 and 236 collectively define a recess shown generally at 244 diametrically opposed from the recess 242 and that is open at the front side 164 of the front interface body portion 160 and that terminates at the end surface 240.

The rear interface body portion 162 also defines generally semi-cylindrical recesses shown generally at 246 and 248, each recessed in the front surface 218, each extending between the peripheral outer surface 222 and the aperture 224, and each sized to receive a portion of the threaded inserts 140 and 146 respectively.

Further, when the front interface body portion 160 is attached to the rear interface body portion 162 as described above, the recesses 191 and 192 are aligned with the recesses 246 and 248 such that the recesses 191 and 246 collectively receive the threaded insert 140 and the recesses 192 and 248 collectively receive the threaded insert 146.

The rear interface body portion 162 also defines generally semi-cylindrical recesses shown generally at 250 and 252, each recessed in the front surface 218, and each spaced apart from the peripheral outer surface 222 and from the aperture 224 such that the recesses 250 and 252 terminate at radially inward end surfaces 254 and 256 respectively and at radially outward end surfaces 258 and 260 respectively. The rear interface body portion 162 defines generally semi-circular openings shown generally at 262 and 264, each extending between the peripheral outer surface 222 and the end surfaces 258 and 260 respectively such that the recesses 250 and 252 are open to the peripheral outer surface 222 through the openings 262 and 264.

Further, the recesses 250 and 252 are aligned with the recesses 194 and 196 respectively and the openings 262 and 264 are aligned with the openings 206 and 208 respectively such that, when the front interface body portion 160 is attached to the rear interface body portion 162 as described above, the recesses 194 and 250 collectively receive the guide body 156, the recesses 196 and 252 collectively receive the guide body 158, the openings 206 and 262 collectively receive a portion of the retaining body 148 with another portion of the retaining body 148 in contact with the spring 152 inside the guide body 156 and retained behind the end surfaces 202 and 258, and with the openings 208 and 264 collectively receiving a portion of the retaining body 150 with another portion of the retaining body 150 in contact with the spring 154 in the guide body 158 and retained behind the end surfaces 204 and 260.

The springs 152 and 154 urge the retaining bodies 148 and 150 radially outward relative to the front interface body portion 160 and the rear interface body portion 162, and when the retaining bodies 148 and 150 are positioned radially outward in deployed positions against the end surfaces 202, 204, 258, and 260, portions of the retaining bodies 148 and 150 extend past the peripheral outer surfaces 170 and 222. However, the retaining bodies 148 and 150 are resiliently movable radially inward relative to the front interface body portion 160 and the rear interface body portion 162 against the radially outward forces of the springs 152 and 154 into retracted positions in which the retaining bodies 148 and 150 are positioned behind the peripheral outer surfaces 170 and 222.

Figure 8:
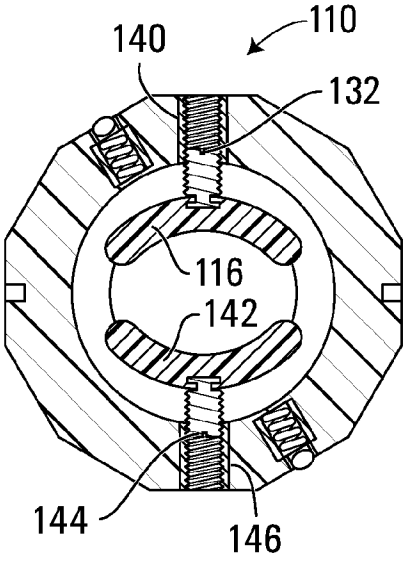
FIG. 8 is the cross-sectional view of FIG. 6, illustrating further movement of attachment bodies and threaded bodies of the interface body of FIG. 4.
Figure 7:
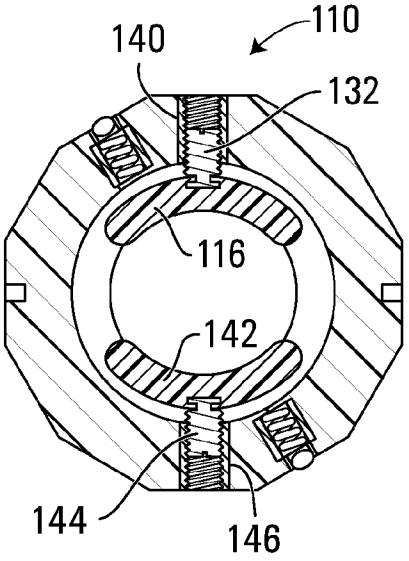
FIG. 7 is the cross-sectional view of FIG. 6, illustrating movement of attachment bodies and threaded bodies of the interface body of FIG. 4.

The rear interface body portion 162 also includes a generally annular wall 266 on the rear side 220 of the rear interface body portion 162 and in the aperture 224, and the generally annular wall 266 includes a front-facing surface 268 facing towards the front side 216 of the rear interface body portion 162 in the aperture 224. The front surface 218 and the front-facing surface 268 are spaced apart by an axial distance of about half of a width of the attachment bodies 116 and 142. Therefore, when the front interface body portion 160 is attached to the rear interface body portion 162 as described above, the rear-facing surface 212 and the front-facing surface 268 are spaced apart by approximately a width of the attachment bodies 116 and 142, and the attachment bodies 116 and 142 may be positioned between the generally annular walls 210 and 266 with opposite lateral surfaces of the attachment bodies 116 and 142 near or abutting the rear-facing surface 212 and the front-facing surface 268. The threaded body 132 may be coupled to the attachment body 116 as described above, and received in the threaded insert 140, such that rotation of the threaded body 132 in the threaded insert 140 causes the threaded body 132, and thus the attachment body 116, to move longitudinally relative to the threaded insert 140, and thus generally radially relative to the generally annular bodies of the interface body 110, as shown in FIGS. 6-8, and the generally annular walls 210 and 266 prevent rotation of the attachment body 116 in response to such rotation of the threaded body 132.

Likewise, the threaded body 144 may be coupled to the attachment body 142 as described above with reference to the threaded body 132 and the attachment body 116, and the threaded body 144 may also be received in the threaded insert 146 such that rotation of the threaded body 144 in the threaded insert 146 causes the threaded body 144 and the attachment body 142 to move longitudinally relative to the threaded insert 146, and thus generally radially relative to annular bodies of the interface body 110 as shown in FIGS. 6-8, and again the generally annular walls 210 and 266 prevent rotation of the attachment body 142 in response to such rotation of the threaded body 144.

Figure 9:
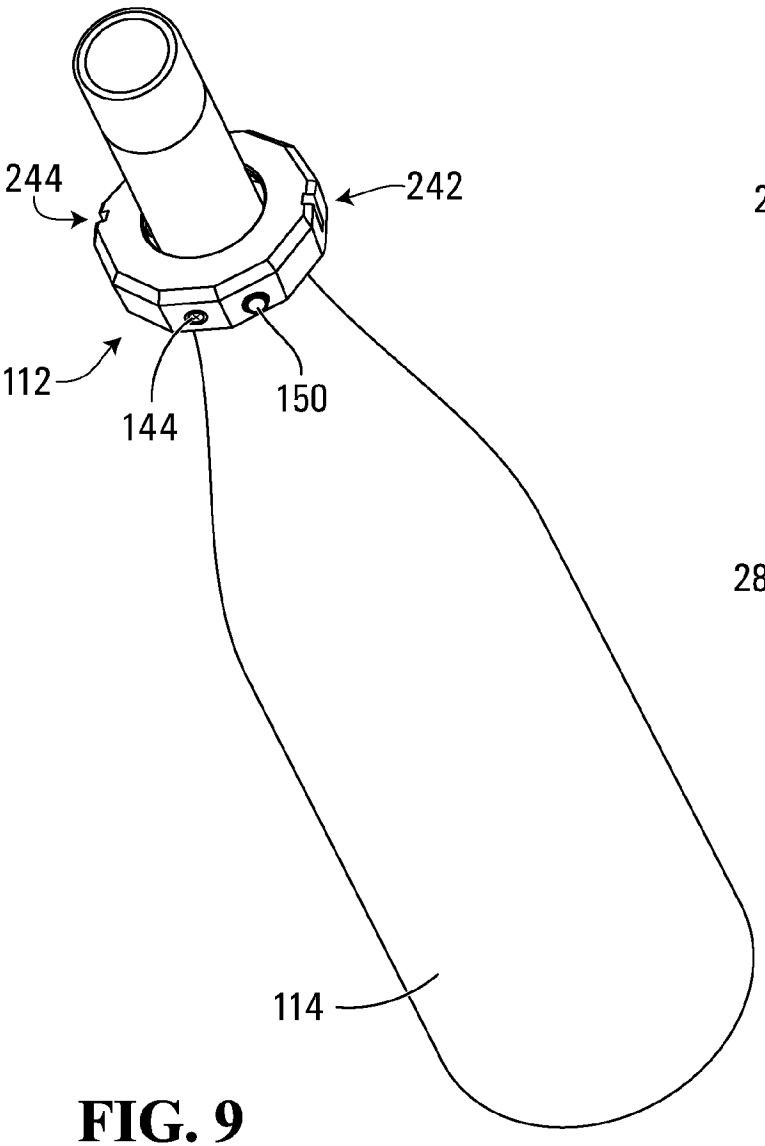
FIG. 9 is a perspective view showing the interface body of FIG. 4 attached to a wine bottle.
Figure 11:
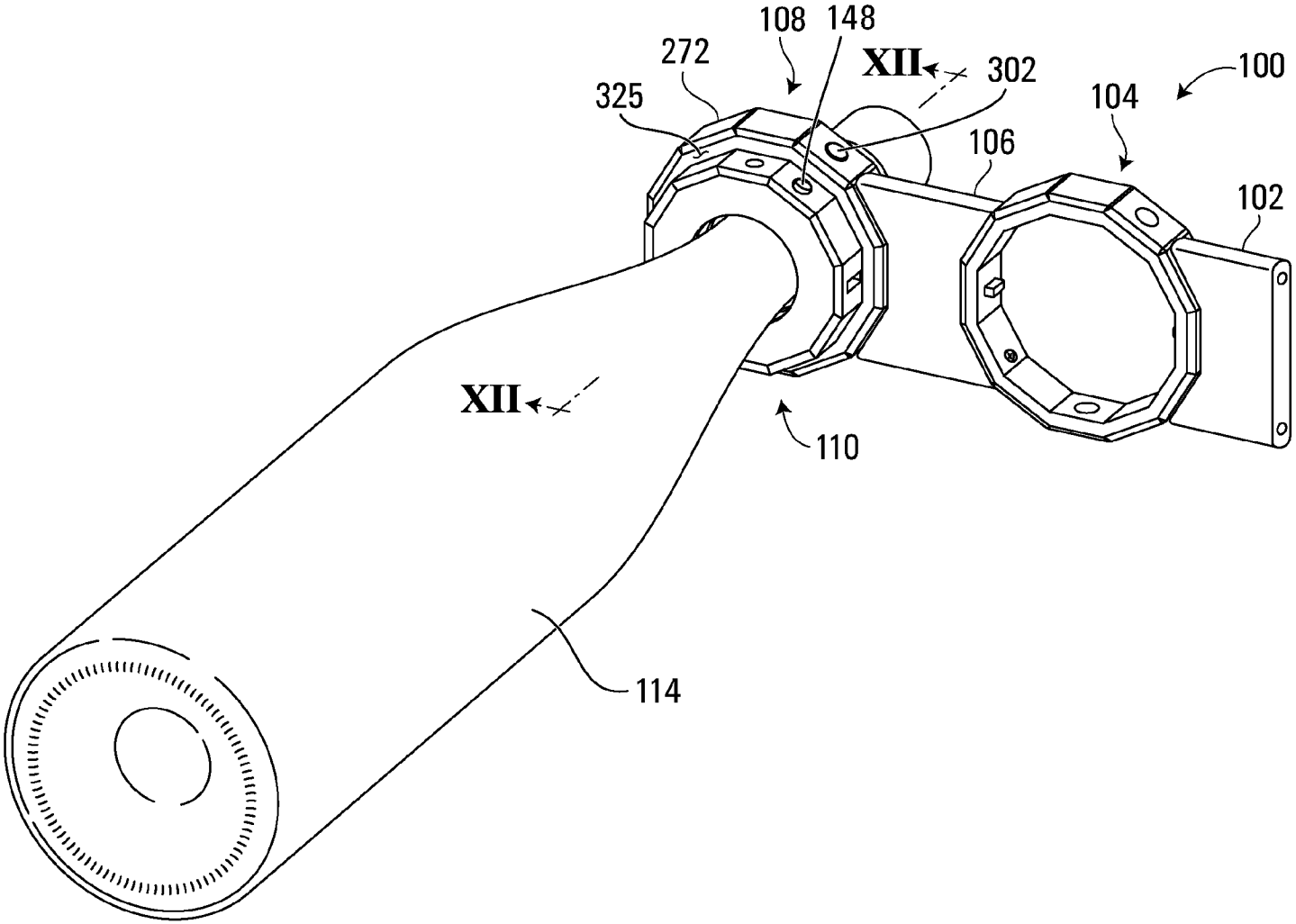
FIG. 11 is a perspective view of the bottle mounting system of FIG. 1, illustrating a method of attaching the interface body of FIG. 4 to the support body of FIG. 10.

A through-opening shown generally at 270 in the generally annular wall 266 also has a diameter sufficient to receive a portion of the neck 112. For example, the diameter of the through-opening 270 may also be between about 20 mm and about 25 mm. As shown in FIG. 9, the neck 112 may be received through the through-openings 214 and 270, and one or both of the threaded bodies 132 and 144 may be rotated to move one or both of the attachment bodies 116 and 142 into positions that are fixed by the threaded bodies 132 and 144. The foxed positions of the attachment bodies 116 and 142 cause frictional engagement of the attachment bodies 116 and 142 with the outer surface 126 of the neck 112.

The attachment bodies 116 and 142, the threaded bodies 132 and 144, and the threaded inserts 140 and 146 thus collectively function as a clamp to clamp the neck 112 when the neck 112 is received through the through-openings 214 and 270. More generally, the attachment bodies 116 and 142, the threaded bodies 132 and 144, and the threaded inserts 140 and 146 attach the interface body 110 to a portion of the wine bottle 114, which is a portion of the neck 112 in the embodiment shown, when the portion of the wine bottle 114 is in an aperture of the interface body 110 formed by the apertures 171 and 224. Further, the attachment bodies 116 and 142, the threaded bodies 132 and 144, and the threaded inserts 140 and 146 attach the interface body 110 to the portion of the wine bottle 114 independently of the support body 108 and independently of gravitational forces on the bottle. In the embodiment shown, the attachment bodies 116 and 142, the threaded bodies 132 and 144, and the threaded inserts 140 and 146 are sized and positioned to attach to a portion of the neck 112, and for example a separation distance between the attachment bodies 116 and 142 may be adjustable between about 15 mm and about 25 mm, but alternative embodiments may be sized or positioned differently.

Figure 10:
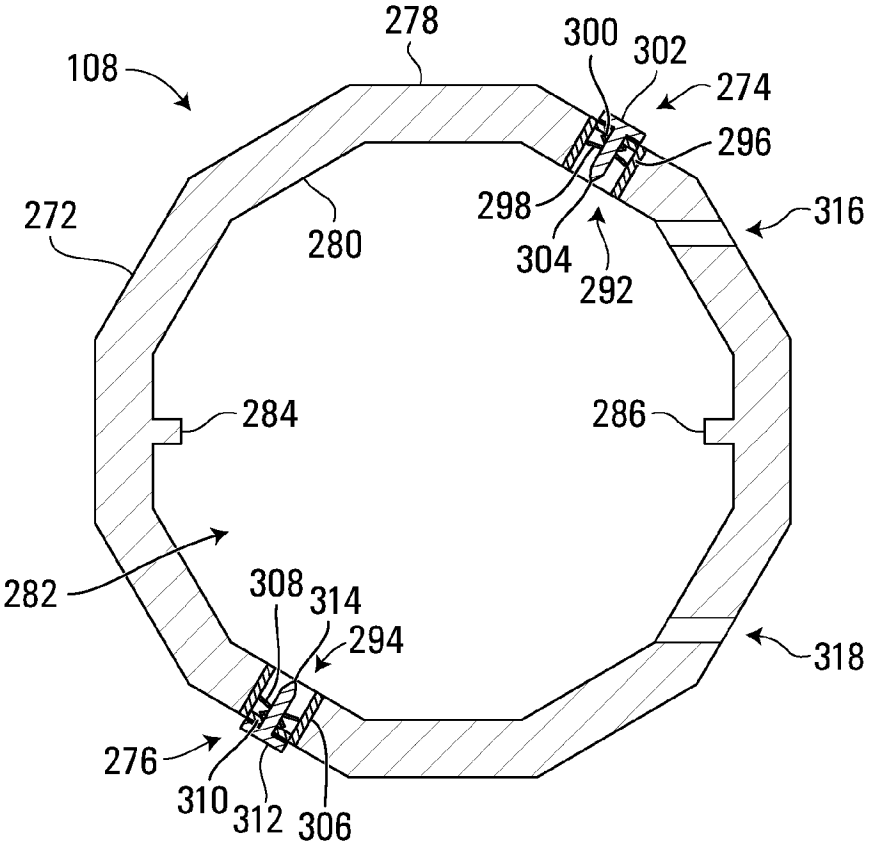
FIG. 10 is a cross-sectional view of a support body of the bottle mounting system of FIG. 1.

Referring to FIGS. 1 and 10, the support body 108 includes a generally annular body 272 and actuator assemblies shown generally at 274 and 276. The generally annular body 272 has an outer peripheral surface 278 and an inner surface 280 surrounding an aperture shown generally at 282. The generally annular body 272 defines projections 284 and 286, which project radially inward from the inner surface 280 in the aperture 282, and which extend axially to be received in the recesses 242 and 244 respectively as the interface body 110 moves generally axially relative to the support body 108 until at least a portion of the interface body 110 is received in the aperture 282 of the support body 108. The end surface 238 is positioned to contact the projection 284, and the end surface 240 is positioned to contact the projection 286 to prevent the interface body 110 from passing completely through the aperture 282.

Further, contact between surfaces of the projections 284 and 286 and of the recesses 242 and 244 prevents axial rotation (that is, rotation about an axis 288 through the apertures 171 and 224 and surrounded by the interface body 110), and thus prevent axial rotation of the wine bottle 114, relative to the support body 108. Further, contact between surfaces of the projections 284 and 286 with surfaces of the recesses 242 and 244 maintain axial alignment (that is, general alignment of the axis 288 with an axis 290 through the aperture 282 and surrounded by the generally annular body 272). Further, generally planar outer surfaces of the peripheral outer surfaces 170 and 222 contact generally planar inward-facing surfaces of the inner surface 280, which also prevent axial rotation of the interface body 110 (and thus of the wine bottle 114) relative to the support body 108, and maintain axial alignment of the interface body 110 relative to the support body 108.

The generally annular body 272 defines through-openings shown generally at 292 and 294 for receiving the actuator assemblies 274 and 276 respectively. The actuator assembly 274 includes a generally cylindrical body 296 received within the through-opening 292. In a generally cylindrical through-opening of the body 296, a leaf spring 298 contacts a washer 300, which contacts an actuator body 302. The leaf spring 298 resiliently urges the actuator body 302 radially outward relative to the generally annular body 272, but actuation of the actuator body 302 can move the actuator body 302 radially inward relative to the generally annular body 272. The actuator body 302 includes a contact surface 304 positioned to contact the retaining body 148 when at least a portion of the interface body 110 is received in the aperture 282 as described above. Likewise, the actuator assembly 276 includes a generally cylindrical body 306 and a leaf spring 308, a washer 310, and an actuator body 312 having a contact surface 314 positioned to contact the retaining body 150 when at least a portion of the interface body 110 is received in the aperture 282 as described above.

The generally annular body 272 also defines through-openings shown generally at 316 and 318, which receive respective fasteners to fasten the support body 108 to the rack body 106, and as shown in FIG. 1, other fasteners may fasten the rack body 106 to the support body 104 (which is substantially the same as the support body 108) and may fasten the rack body 102 to the support body 104 and to a structure 320 such as a wall for example.

Figure 12:
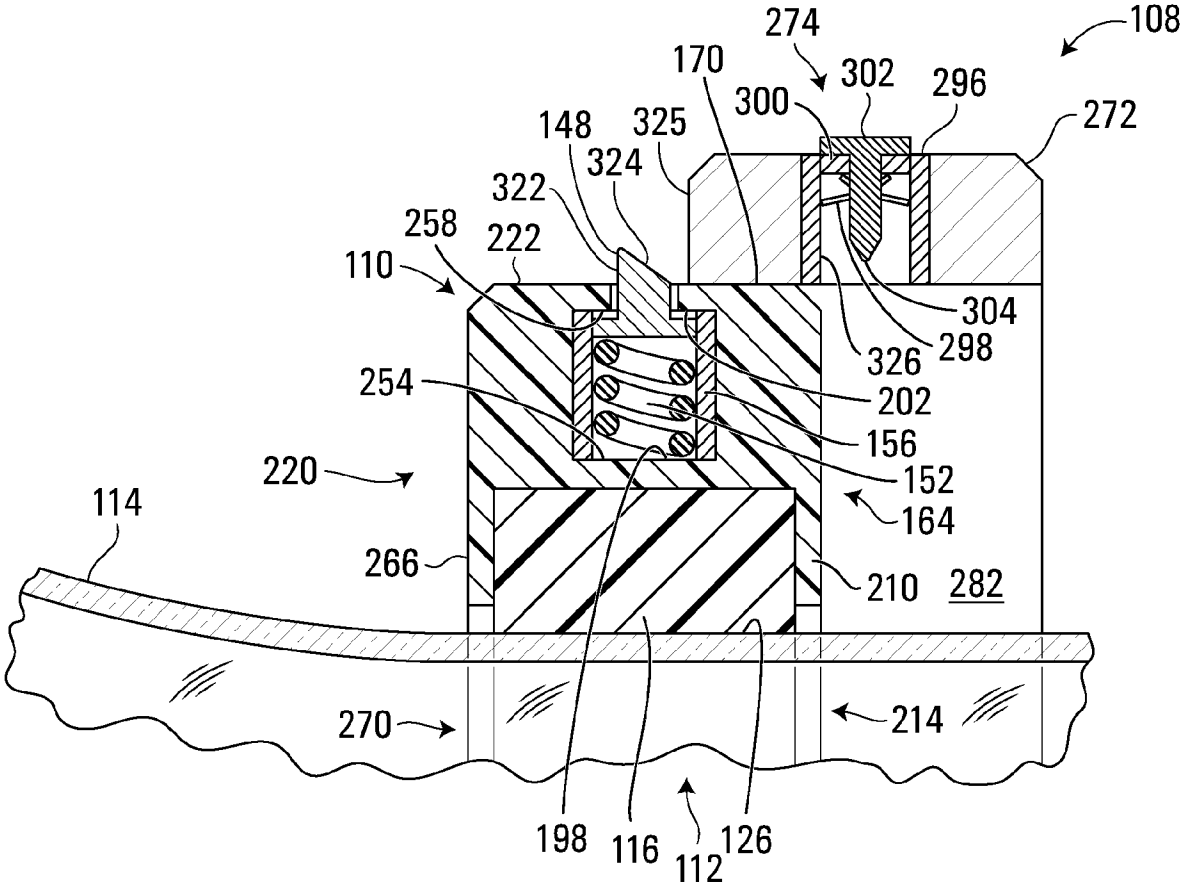
FIG. 12 is a cross-sectional view of the bottle mounting system of FIG. 1 during the method illustrated in FIG. 11 and taken along the line XII-XII in FIG. 11.

Referring to FIG. 12, the interface body 110 may be attached to the support body 108 when the portion of the neck 112 is attached to the interface body 110 as described above, by positioning at least a portion of the interface body 110 and the portion of the neck 112 in the aperture 282 after the interface body 110 is attached to the portion of the neck 112. As shown in FIG. 12, the retaining body 148 has a rear surface 322 facing the rear side 220 of the rear interface body portion 162. The retaining body 148 also has a tapered outer surface 324 facing radially outward relative to the generally annular body 272 and also tapered radially inward relative to the generally annular body 272 from the rear surface 322 such that the tapered outer surface 324 also faces the generally annular body 272 as the at least a portion of the interface body 110 is positioned in the aperture 282 as shown in FIG. 12.

When the tapered outer surface 324 contacts a generally annular outer surface 325 of the generally annular body 272, movement of the interface body 110 into the aperture 282 causes the retaining body 148 to move resiliently and radially inward relative to the front interface body portion 160 and the rear interface body portion 162 against the radially outward resilient force of the spring 152 until the retaining body 148 is also received in the aperture 282. Eventually, a portion of the retaining body 148 is received in the generally cylindrical body 296 as shown in FIG. 13, with the rear surface 322 contacting an inner surface 326 of the generally cylindrical body 296.

Figure 13:
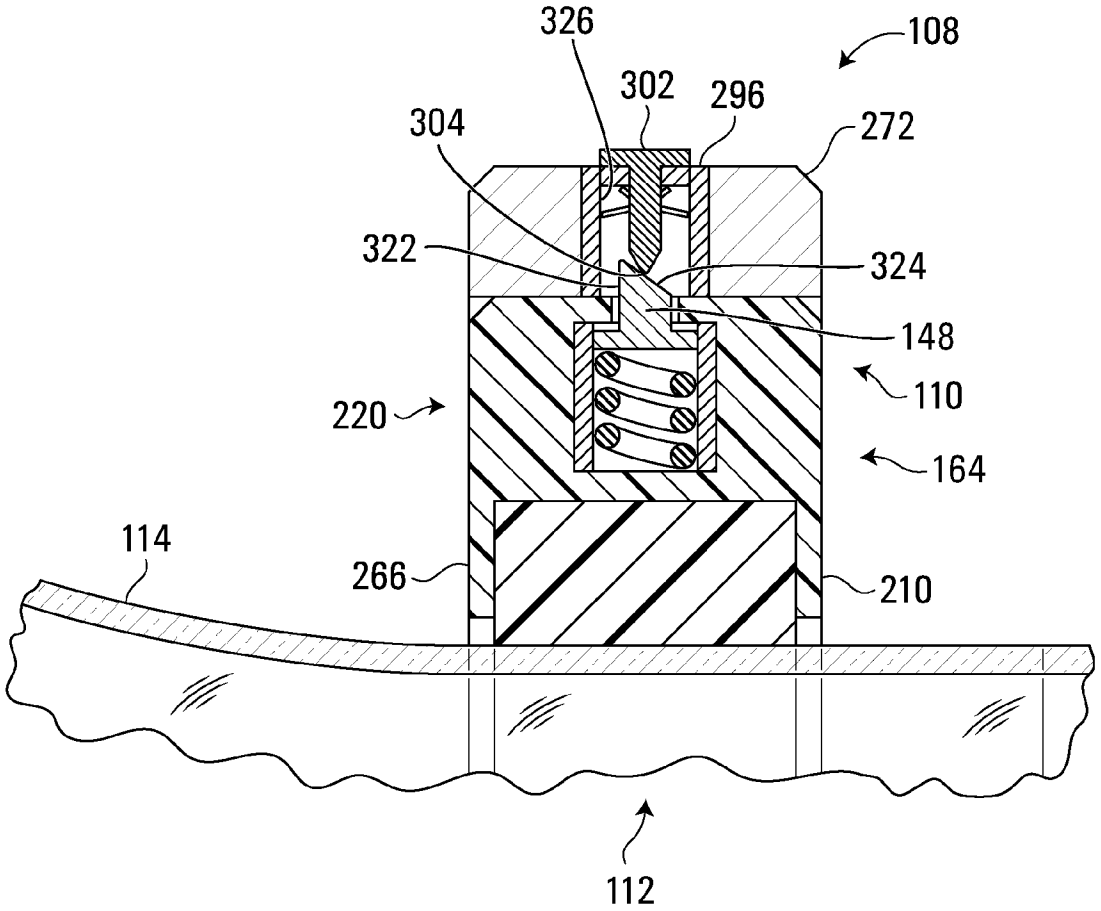
FIG. 13 is another cross-sectional view of the bottle mounting system of FIG. 1 during the method illustrated in FIG. 11.

When the portion of the retaining body 148 is received in the generally cylindrical body 296 as shown in FIG. 13, the rear surface 322 can contact the surface 326 to prevent movement of the interface body 110, and thus of the wine bottle 114, in a direction towards the rear side 220 of the rear interface body portion 162. Further, as indicated above, contact of the projections 284 and 286 against the end surfaces 238 and 240 respectively prevents movement of the interface body 110, and thus of the wine bottle 114, in a direction towards the front side 164 of the front interface body portion 160. The interface body 110 is thus attached to the support body 108, as shown in FIG. 14, and the rear surface 322 and the surface 326 are thus complementarily attachable attachment surfaces that facilitate attaching the interface body 110 to the support body 108 when at least a portion of the interface body 110 and the portion of the neck 112 are positioned within an aperture of the interface body 110 formed by the apertures 171 and 224 and after the interface body 110 is attached to the portion of the neck 112.

Figure 14:
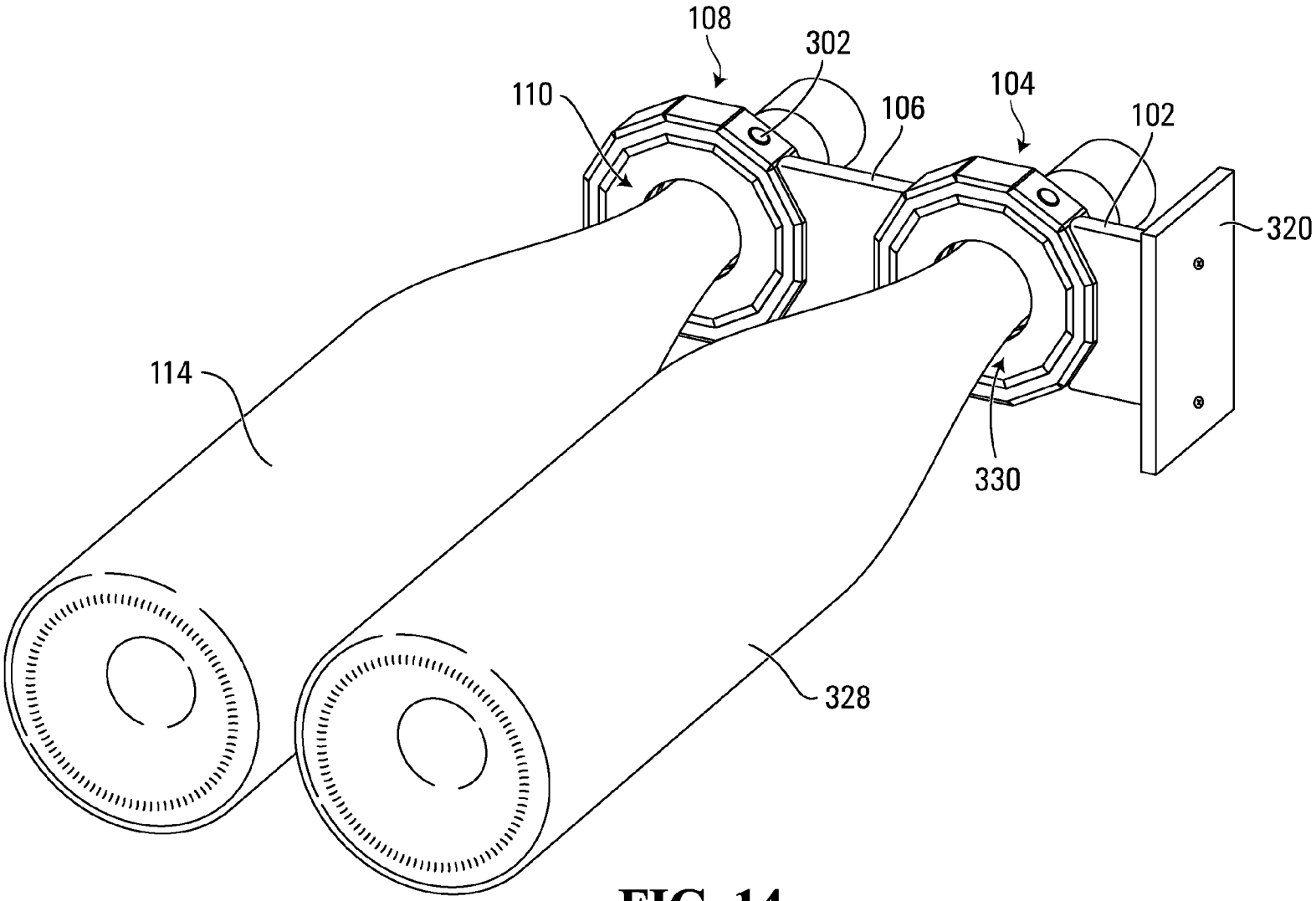
FIG. 14 is a perspective view showing another interface body of the bottle mounting system of FIG. 1, attached to another wine bottle and to another support body of the bottle mounting system of FIG. 1.

FIG. 14 also illustrates a wine bottle 328 attached to an interface body shown generally at 330 and substantially the same as the interface body 110. Further, as shown in FIG. 14, the interface body 330 is attached to the support body 104 as described above with reference to the interface body 110 and the support body 108.

Figure 15:
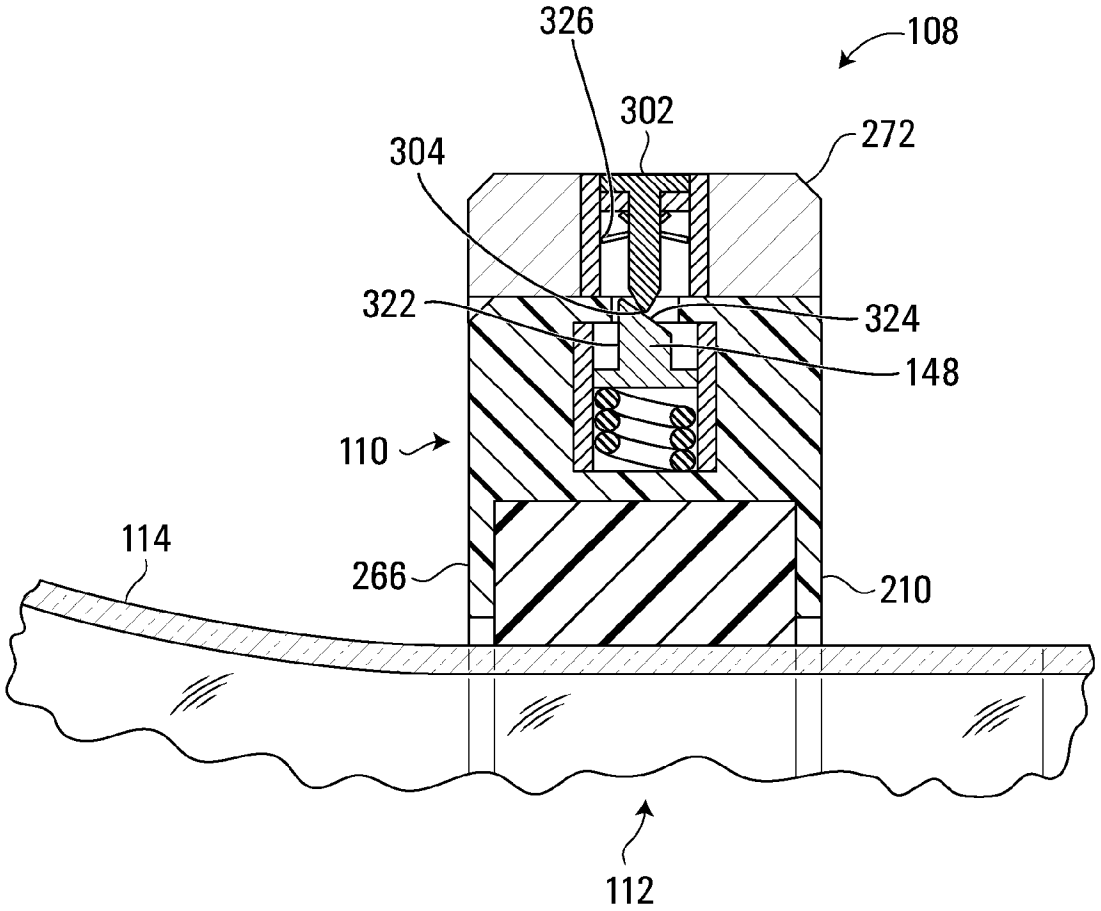
FIG. 15 is a cross-sectional view of the bottle mounting system of FIG. 1, illustrating a method of detaching the interface body of FIG. 4 from the support body of FIG. 10.

Referring to FIG. 15, a person may exert force on the actuator body 302, for example by contacting the actuator body 302 with a thumb, finger, or separate tool (not shown) to move the actuator body 302 radially inward relative to the generally annular body 272 in a direction towards the retaining body 148. The contact surface 304 transfers such forces from the actuator body 302 to the retaining body 148 and moves the retaining body 148 radially inward relative to the front interface body portion 160 and the rear interface body portion 162 and against the radially outward resilient force of the spring 152 until the rear surface 322 is separated and disengaged from the surface 326. When the rear surface 322 is separated from the surface 326 as shown in FIG. 15, the interface body 110 is detached from the support body 108, and the interface body 110 may be detached from the support body 108 while the portion of the neck 112 remains attached to the interface body 110.

The retaining body 150 functions in substantially the same way as the retaining body 148, and the actuator assembly 276 functions in substantially the same way as the actuator assembly 274.

Figure 16:
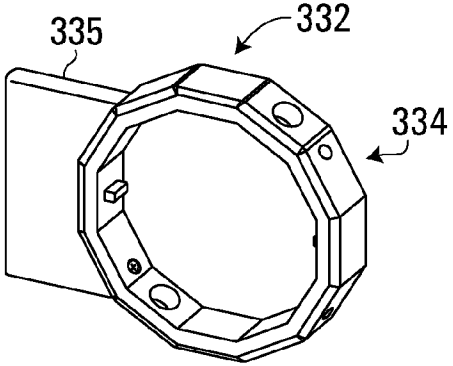
FIG. 16 is a perspective view of a bottle mounting system according to another embodiment.

Alternative embodiments may vary in many ways from the bottle mounting system 100. For example, referring to FIG. 16, a bottle mounting system according to another embodiment is shown generally at 332 and includes a single support body shown generally at 334. The support body 334 is substantially the same as the support body 108, and is attached to a single rack body 335. The rack body 335 is substantially the same as the rack body 102, and may be mounted to a structure, such as the structure 320 for example. The bottle mounting system 332 may thus mount a single bottle to such a structure.

Figure 17:
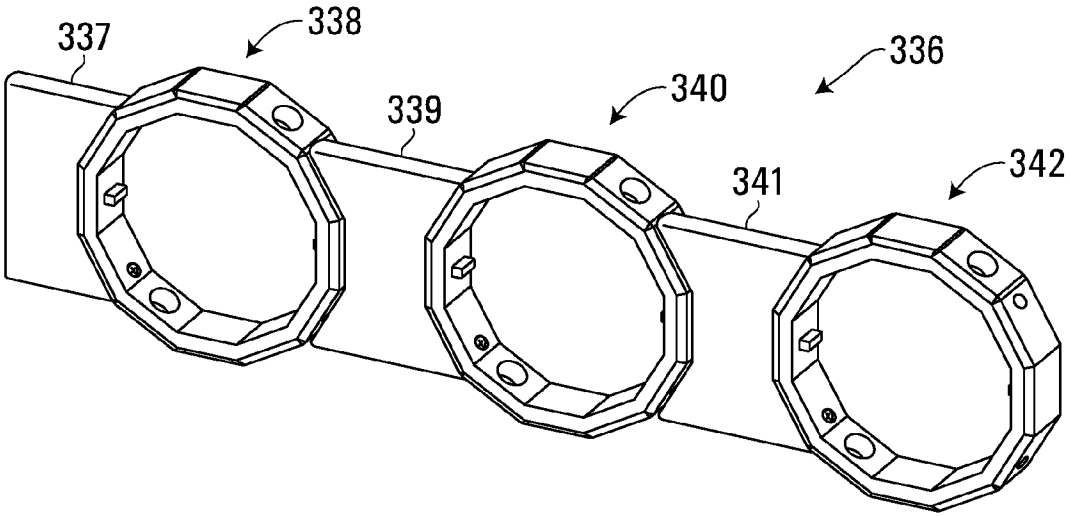
FIG. 17 is a perspective view of a bottle mounting system according to another embodiment.

Referring to FIG. 17, a bottle mounting system according to another embodiment is shown generally at 336 and includes support bodies 338, 340, and 342, which are substantially the same as the support body 108. A rack body 337 is substantially the same as the rack body 102 and may mount the support body 338 to a structure such as the structure 320. A rack body 339 is attached to the support bodies 338 and 340, and a rack body 341 is attached to the support bodies 340 and 342. The rack bodies 339 and 341 are substantially the same as the rack body 106. The bottle mounting system 336 may therefore mount up to three bottles on a structure such as the structure 320 for example.

Figure 18:
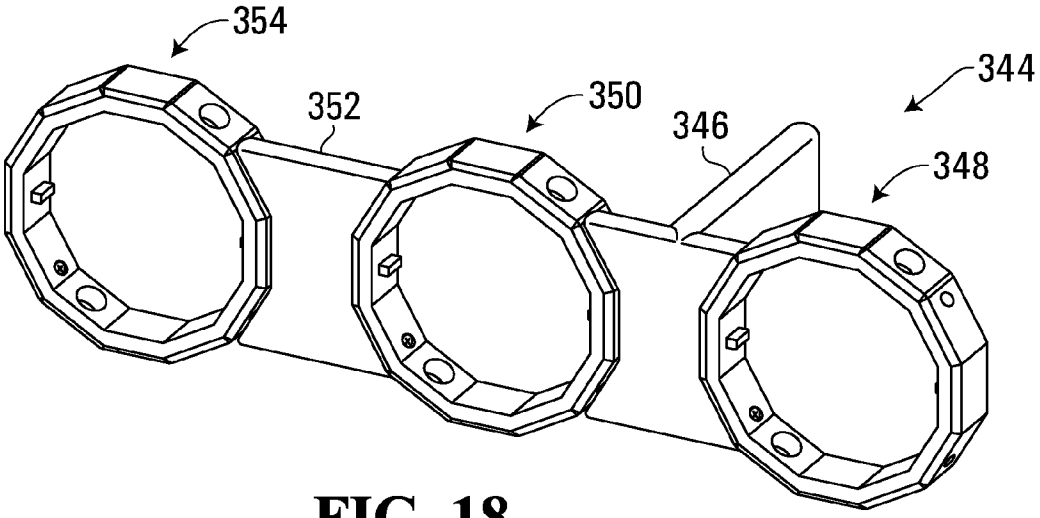
FIG. 18 is a perspective view of a bottle mounting system according to another embodiment.

Referring to FIG. 18, a bottle mounting system according to another embodiment is shown generally at 344 and includes a rack body 346 that is T-shaped to mount support bodies shown generally at 348 and 350 to a structure (such as the structure 320 for example) but generally parallel to such a structure instead of generally perpendicular as in the embodiments described above. The bottle mounting system 344 also includes a rack body 352, which is substantially the same as the rack body 106, and which attaches the support body 350 to a support body 354. The support bodies 348, 350, and 354 are substantially the same as the support body 108, and the bottle mounting system 344 thus permits up to three bottles to be mounted to a structure generally perpendicular to the structure, instead of generally parallel to the structure as in the embodiments described above.

Figure 19:
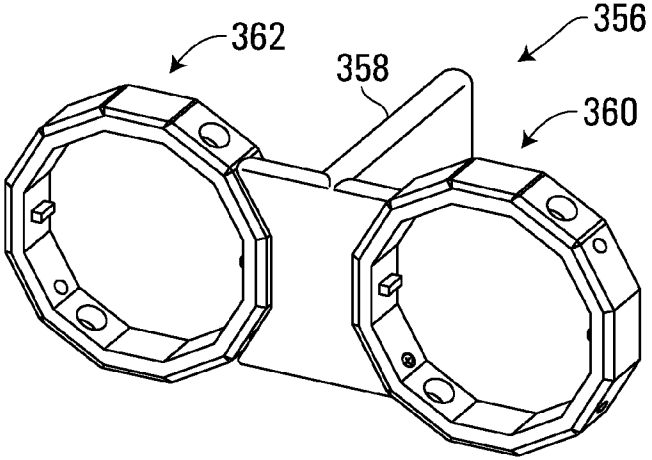
FIG. 19 is a perspective view of a bottle mounting system according to another embodiment.

Referring to FIG. 19, a bottle mounting system according to another embodiment is shown generally at 356, and includes a rack body 358 supporting support bodies 360 and 362. The rack body 358 is substantially the same as the rack body 346, and the support bodies 360 and 362 are substantially the same as the support body 108. Therefore, the bottle mounting system 356 permits mounting up to two bottles on a structure (such as the structure 320 for example).

Figure 20:
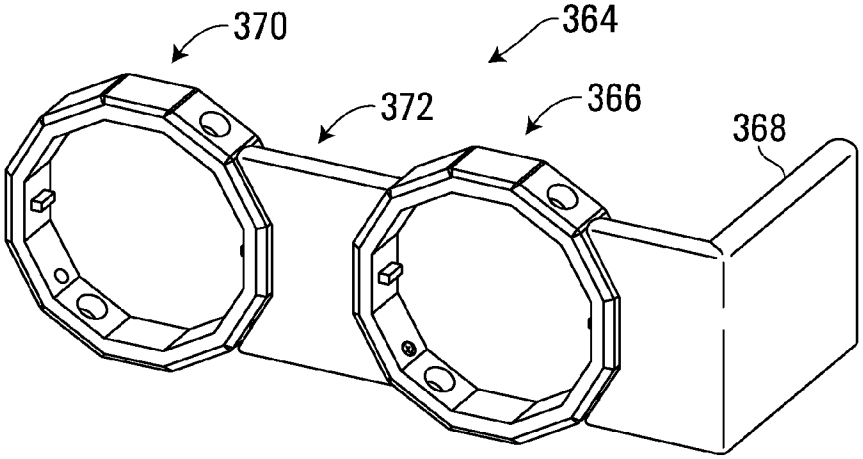
FIG. 20 is a perspective view of a bottle mounting system according to another embodiment.

Referring to FIG. 20, a bottle mounting system according to another embodiment is shown generally at 364 and includes a support body 366 attached to an L-shaped rack body 368, which supports a single support body on a structure (such as the structure 320, for example) generally parallel to such a structure. The bottle mounting system 364 also includes a support body 370 and a rack body 372 attaching the support body 370 to the support body 366. The support bodies 366 and 370 are substantially the same as the support body 108, and the rack body 372 is substantially the same as the rack body 106. The bottle mounting system 364 therefore permits up to two bottles to be supported on a structure (such as the structure 320, for example) generally perpendicular to such a structure. Although FIGS. 16-20 illustrate various different embodiments, still other embodiments may include still other combinations of support bodies such as those described herein and various different rack bodies and other bodies.

Figure 21:
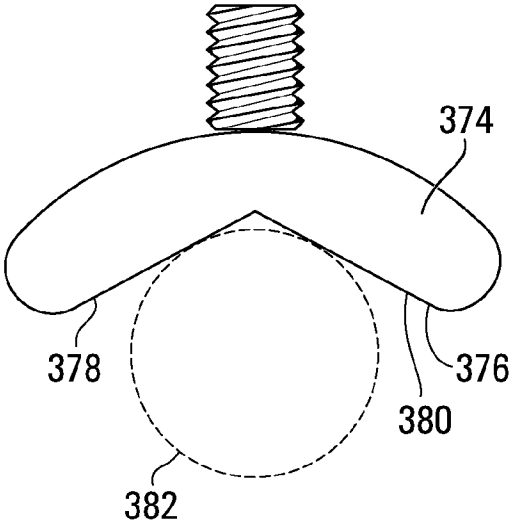
FIG. 21 is an elevation view of an attachment body and a threaded body according to another embodiment.

FIG. 21 illustrates an attachment body 374 according to another embodiment. The attachment body 374 is substantially the same as the attachment body 116, although the attachment body 374 has a bottle-contacting surface 376 that is V-shaped with a generally planar portion 378 and a generally planar portion 380 adjacent and extending non-parallel to the generally planar portion 378. The generally planar portions 378 and 380 may contact an outer surface of a portion of a neck 382 of a wine bottle at two contact locations, which may in some embodiments provide greater contact than the attachment body 116. In general, alternative embodiments may include attachment bodies such as the attachment body 374 in place of other attachment bodies described herein.

Figure 22:
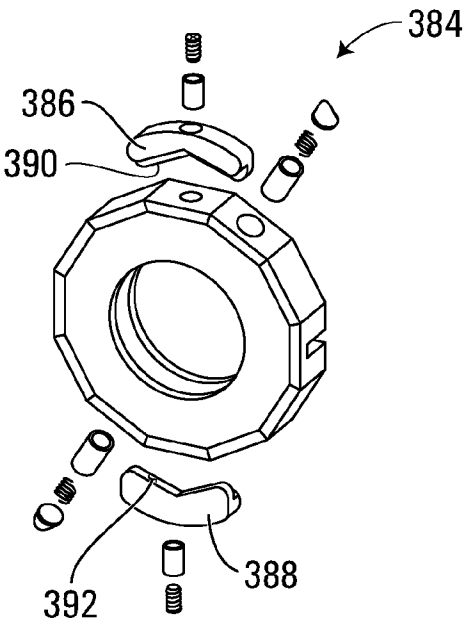
FIG. 22 is an exploded perspective view of an interface body according to another embodiment.
Figure 23:
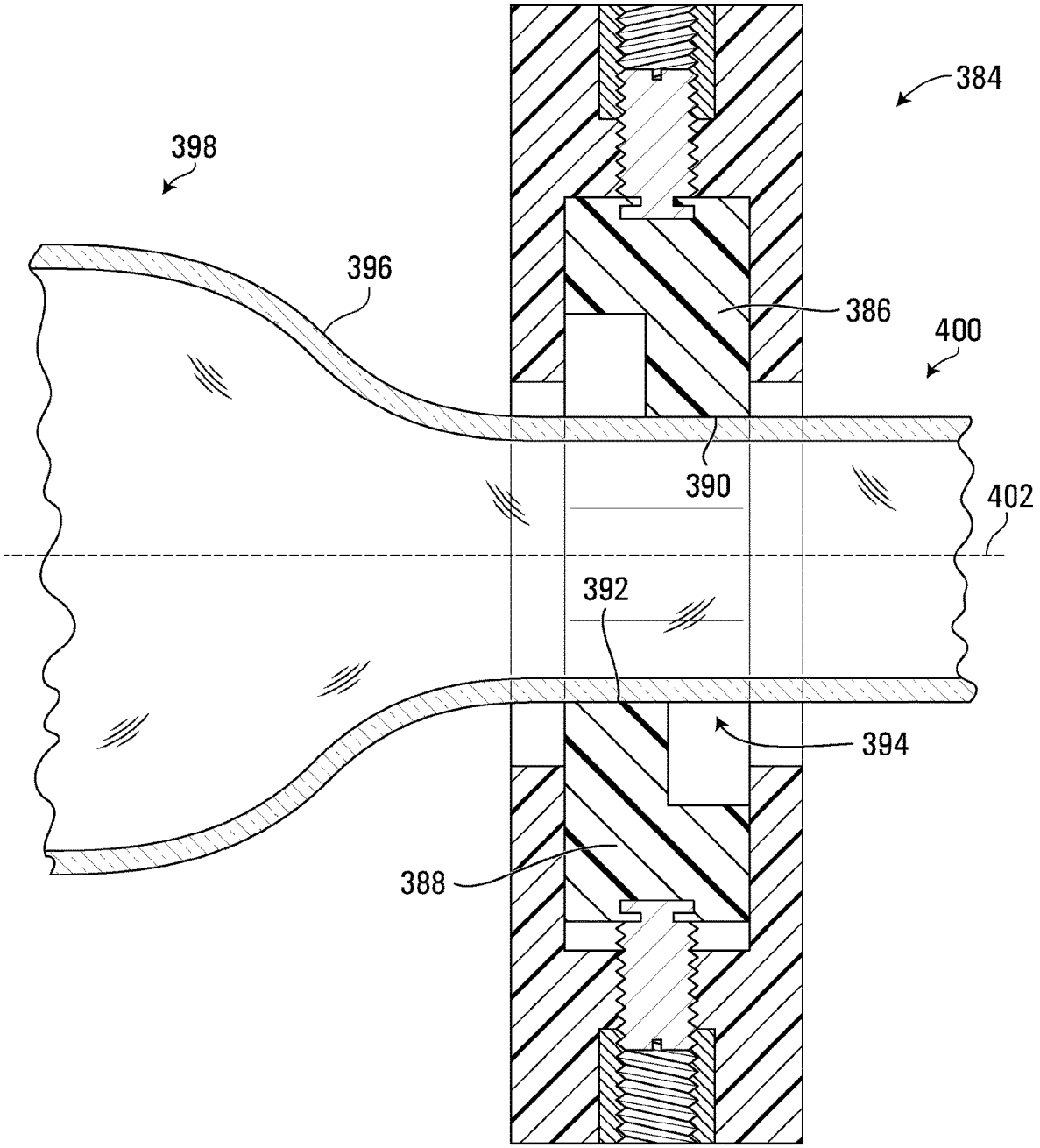
FIG. 23 is a cross-sectional view of the interface body of FIG. 22, assembled and attached to another wine bottle.

Referring to FIGS. 22 and 23, an interface body according to another embodiment is shown generally at 384 and is substantially the same as the support body 108, except that the interface body 384 includes attachment bodies 386 and 388 that include bottle-contacting surfaces 390 and 392 respectively that are axially spaced apart from each other. As shown in FIG. 23, the attachment bodies 386 and 388 may be positioned such that the bottle-contacting surfaces 390 and 392 contact an outer surface of a neck shown generally at 394 of a wine bottle 396. A portion shown generally at 398 of the wine bottle 396 on one side of the interface body 384 is heavier than a portion shown generally at 400 of the wine bottle 396 on an opposite side of the interface body 384. In the embodiment shown, the bottle-contacting surface 392 is below the neck 394 and closer to the heavier portion 398 than the bottle-contacting surface 390, and the bottle-contacting surface 390 is above the neck 394 and closer to the lighter portion 400 than the bottle-contacting surface 392. Therefore, the attachment bodies 386 and 388 may be positioned to control an inclination of an axis 402 of the wine bottle 396 relative to an axis of the interface body 384, for example in some embodiments to maintain the axis 402 generally horizontal and aligned to the axis of the interface body 384. In general, alternative embodiments may include attachment bodies such as the attachment bodies 386 and 388 in place of other attachment bodies described herein.

Figure 24:
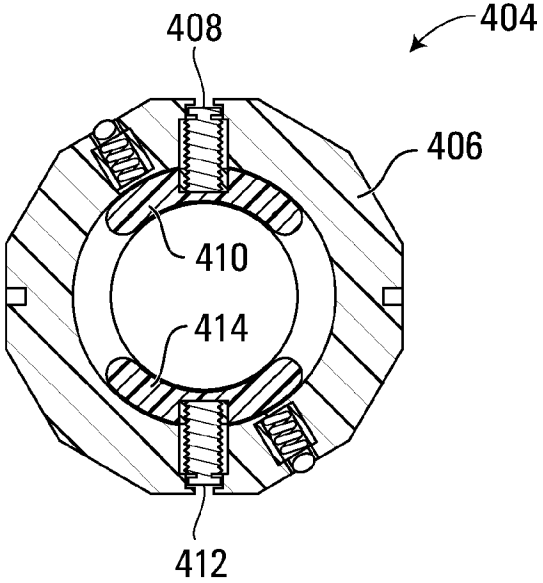
FIG. 24 is a cross-sectional view of an interface body according to another embodiment.

Referring to FIG. 24, an interface body according to another embodiment is shown generally at 404 and includes a generally annular body 406, a threaded body 408 rotatably coupled to the generally annular 406 and to an attachment body 410, and a threaded body 412 rotatably coupled to the generally annular body 406 and to an attachment body 414. However, unlike the embodiments described above, external threads of the threaded bodies 408 and 412 engage internal threads in the attachment bodies 410 and 414 instead of internal threads in the generally annular body 406, such that rotation of the threaded bodies 408 and 412 causes the attachment bodies 410 and 414 to move generally as described above, but without causing radial movement of the threaded bodies 408 and 412. In general, alternative embodiments may include interface bodies such as the interface body 404 in place of other interface bodies described herein.

Figure 25:
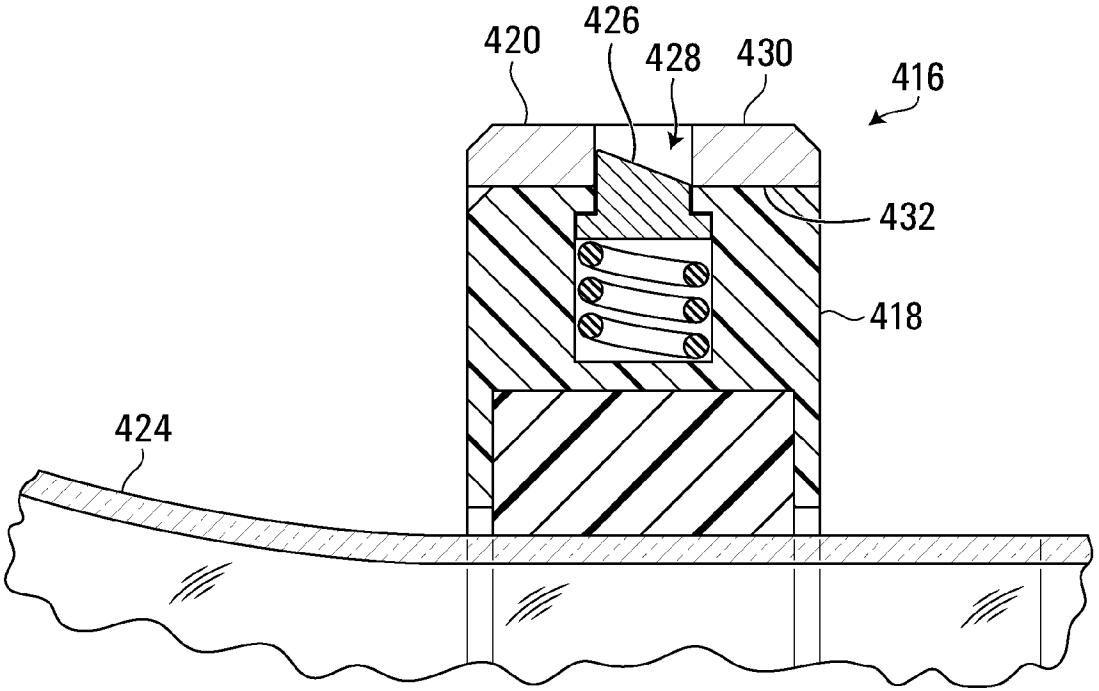
FIG. 25 is a partial cross-sectional view of an interface body according to another embodiment, attached to a support body and to another wine bottle.

Referring to FIG. 25, a bottle mounting system according to another embodiment is shown generally at 416 and includes an interface body 418 attached to a support body 420 and to a portion of a neck shown generally at 422 of a wine bottle 424. The interface body 418 and the support body 420 are substantially the same as the interface body 110 and the support body 108 respectively, and for example the interface body 418 includes a retaining body 426 that functions substantially the same as the retaining bodies 148 and 150 by attaching the interface body 418 to the support body 420 when a portion of the retaining body 426 is received in a through-opening shown generally at 428 in the support body 420 and extending between an outer peripheral surface 430 and an inner surface 432 of the support body 420. However, the interface body 418 does not include guide bodies (such as the guide bodies 156 and 158) and the support body 420 does not include actuator assemblies (such as the actuator assemblies 274 and 276). Therefore, instead of actuating actuator bodies to remove the retaining body 426 from the through-opening 428 to detach the interface body 418 from the support body 420, a person may exert force directly on the retaining body 426, for example by contacting the retaining body 426 directly with a thumb, finger, or separate tool (not shown) to remove the retaining body 426 from the through-opening 428 to detach the interface body 418 from the support body 420. In general, alternative embodiments may include interface bodies such as the interface body 418 in place of other interface bodies described herein and support bodies such as the support body 420 in place of other support bodies described herein.

More generally, in alternative embodiments, components as described herein may be repeated, varied, positioned or oriented differently, or omitted. For example, actuator assemblies and attachment bodies may be positioned differently in other embodiments. Also, some embodiments may include different springs or resilient bodies instead of the springs 152 and 154, and some embodiments may include different springs or resilient bodies instead of the leaf springs 298 and 308, or the leaf springs 298 and 308. Further, although the interface bodies and support bodies of the embodiments shown include complementary polygonal surfaces, alternative embodiments may include other shapes such as circular or irregularly shaped surfaces.

Further, in alternative embodiments, some apertures or openings that are described herein may be varied to extend completely through the bodies that define the apertures or openings, or may be varied to be closed partially or fully in one or more places. In general, the varies bodies and other components may be made from one or more of various different materials such as metal and plastic, and may be formed by one or more of machining, molding, casting, and three-dimensional printing in various embodiments. Further, in alternative embodiments, components that are illustrated as unitarily formed may be formed from more than one body, and components that are illustrated as more than one body may be unitarily formed or formed from separate bodies that differ from those that are illustrated and described. For example, some or all of the components of the rack body 102, the support body 104, the rack body 106, and the support body 108 may be integrally formed or formed from different bodies.

Embodiments such as those described herein may facilitate storing, organizing, and dispensing wine from wine bottles, for example. Interface bodies such as those described herein may be attached to necks of wine bottles as described above, and may function as collars or drip catches to catch wine that may spill when wine is poured from the wine bottles. Further, in some embodiments, interface bodies such as those described herein may facilitate categorizing or maintaining an inventory of wine. For example, interface bodies such as those described herein may be colour-coded or include other visual or tactile indicia to indicate information about the wine in bottles to which the interface bodies are attached. Further, interface bodies such as those described herein may include barcodes or radio-frequency identification ("RFD") identifiers to track movement of wine bottles or to facilitate in maintaining an inventory of wine bottles. Also, interface bodies such as those described herein may facilitate storing bottles of wine by attaching to and detaching from support bodies such as those described herein, which may be mounted to walls or other structures in a wine rack.

Although specific embodiments have been described and illustrated, such embodiments should be considered illustrative only and not as limiting the invention as construed according to the accompanying claims.

The invention claimed is:

1. A method of mounting a bottle using a bottle mounting system that includes:

a support body; and an interface body comprising:

a clamp attachable to a portion of the bottle; and an attachment surface attachable to and detachable from the support body when at least a portion of the interface body and the portion of the bottle are positioned within an aperture defined by the support body and when the clamp is attached to the portion of the bottle, wherein the support body comprises at least one actuator, wherein when the interface body is attached to the support body, the at least one actuator is actuatable to detach the interface body from the support body while the interface body remains attached to the portion of the bottle, and wherein the clamp is configured to clamp the portion of the bottle to attach the interface body to the bottle independently of the support body and independently of gravitational forces on the bottle;

the method of mounting the bottle comprising:

when the clamp of the interface body is attached to the portion of the bottle independently of the support body and independently of the gravitational forces on the bottle, and when the at least a portion of the interface body and the portion of the bottle are positioned within the aperture defined by the support body, detachably attaching the attachment surface of the interface body to the support body; and detaching the interface body from the support body while the interface body remains attached to the portion of the bottle, wherein detaching the interface body from the support body comprises actuating the at least one actuator on the support body.

2. The method of claim 1 wherein detaching the interface body from the support body comprises disengaging at least one retaining body on the interface body from a respective at least one retaining surface of the support body, the at least one retaining body having the attachment surface.

3. The method of claim 2 wherein disengaging the at least one retaining body from the respective at least one retaining surface comprises radially repositioning the at least one retaining body to separate the at least one retaining body from the respective at least one retaining surface.

4. The method of claim 2 wherein disengaging the at least one retaining body from the respective at least one retaining surface comprises removing a portion of the at least one retaining body from a respective at least one opening defined by the support body and extending from the aperture of the support body to an outer surface of the support body.

5. The method of claim 1 wherein the portion of the bottle is attached to the interface body in an aperture defined by the interface body.

6. The method of claim 1 further comprising attaching the interface body to the portion of the bottle.

7. The method of claim 6 wherein attaching the interface body to the portion of the bottle comprises frictionally engaging at least one attachment body of the interface body with a surface on the portion of the bottle.

8. The method of claim 7 wherein frictionally engaging the at least one attachment body of the interface body with the portion of the bottle comprises fixing the at least one attachment body in a fixed position against the surface on the portion of the bottle.

9. The method of claim 8 wherein fixing the at least one attachment body in the fixed position comprises rotating a threaded body coupled to the at least one attachment body to position the at least one attachment body in the fixed position.

10. The method of claim 1 wherein the portion of the bottle comprises a portion of a neck of a wine bottle.

11. A bottle mounting system comprising:

a support body; and an interface body comprising:

a first attaching means for attaching the interface body to a portion of a bottle; and a second attaching means for attaching the interface body to the support body such that the interface body is attachable to and detachable from the support body when at least a portion of the interface body and the portion of the bottle are positioned within an aperture defined by the support body and when the first attaching means is attached to the portion of the bottle;

wherein the support body comprises at least one actuator, wherein when the interface body is attached to the support body, the at least one actuator is actuatable to detach the interface body from the support body while the interface body remains attached to the portion of the bottle; and wherein the first attaching means is configured to clamp the portion of the bottle to attach the interface body to the bottle independently of the support body and independently of gravitational forces on the bottle.

12. The system of claim 11 wherein the support body comprises a third attaching means complementary to the second attaching means for attaching the interface body to the support body when the at least a portion of the interface body and the portion of the bottle are positioned within the aperture of the support body and after the first attaching means is attached to the portion of the bottle.

13. A bottle mounting system comprising:

a support body; and an interface body comprising:

a clamp attachable to a portion of a bottle; and a first attachment surface attachable to and detachable from the support body when at least a portion of the interface body and the portion of the bottle are positioned within an aperture defined by the support body and when the clamp is attached to the portion of the bottle, wherein the support body comprises at least one actuator, wherein when the interface body is attached to the support body, the at least one actuator is actuatable to detach the interface body from the support body while the interface body remains attached to the portion of the bottle, and wherein the clamp is configured to clamp the portion of the bottle to attach the interface body to the bottle independently of the support body and independently of gravitational forces on the bottle.

14. The system of claim 13 wherein the support body comprises a second attachment surface attachable to the first attachment surface to attach the interface body to the support body when the at least a portion of the interface body and the portion of the bottle are positioned within the aperture defined by the support body and after the clamp is attached to the portion of the bottle.

15. The system of claim 14 wherein the interface body comprises a retaining body having the first attachment surface and resiliently movable from a deployed position, in which the first attachment surface is positioned to contact the second attachment surface to attach the interface body to the support body when the at least a portion of the interface body is positioned within the aperture of the support body, to a retracted position in which the first attachment surface is positioned to be separated from the second attachment surface when the at least a portion of the interface body is positioned within the aperture of the support body.

16. The system of claim 14 wherein the interface body is detachable from the support body while the interface body remains attached to the portion of the bottle.

17. The system of claim 13 wherein the interface body defines an aperture, and wherein the clamp is positioned to attach to the portion of the bottle in the aperture of the interface body.

18. The system of claim 13 wherein the clamp comprises at least one attachment body frictionally engageable with a surface on the portion of the bottle.

19. The system of claim 18 wherein the at least one attachment body is fixedly positionable in a fixed position against the surface on the portion of the bottle.

20. The system of claim 19 wherein the at least one attachment body is fixedly positionable in the fixed position independently of the support body and independently of gravitational forces on the bottle.

21. The system of claim 19 wherein the interface body comprises a threaded body coupled to the at least one attachment body and rotatable to position the at least one attachment body in the fixed position.

22. The system of claim 13 wherein the interface body comprises a generally annular body that surrounds the portion of the bottle when the clamp is attached to the portion of the bottle.

23. The system of claim 13 wherein the clamp is sized to attach to a portion of a neck of a wine bottle.

24. A bottle mounting system comprising:

a support body; and an interface body comprising:

a clamp attachable to a portion of a bottle; and a first attachment surface attachable to the support body when at least a portion of the interface body and the portion of the bottle are positioned within an aperture defined by the support body and after the clamp is attached to the portion of the bottle;

wherein the support body comprises a second attachment surface attachable to the first attachment surface to attach the interface body to the support body when the at least a portion of the interface body and the portion of the bottle are positioned within the aperture defined by the support body and after the clamp is attached to the portion of the bottle;

wherein the interface body is detachable from the support body while the interface body remains attached to the portion of the bottle; and wherein the interface body comprises a retaining body having the first attachment surface and resiliently movable from a deployed position, in which the first attachment surface is positioned to contact the second attachment surface to attach the interface body to the support body when the at least a portion of the interface body is positioned within the aperture of the support body, to a retracted position in which the first attachment surface is positioned to be separated from the second attachment surface when the at least a portion of the interface body is positioned within the aperture of the support body.

25. The system of claim 24 wherein the second attachment surface defines at least part of an opening extending from the aperture of the support body to an outer surface of the support body and positioned to receive a portion of the retaining body when the at least a portion of the interface body is positioned within the aperture of the support body.

26. The system of claim 24 wherein the retaining body is resiliently movable from the deployed position to the retracted position in a direction generally parallel to a longitudinal axis of the retaining body.

27. The system of claim 24 wherein the interface body comprises a generally annular body, and wherein the retaining body is resiliently movable from the deployed position to the retracted position in a generally radial direction relative to the generally annular body.

28. The system of claim 24 wherein:

the clamp comprises at least one attachment body frictionally engageable with a surface on the portion of the bottle;

the at least one attachment body is fixedly positionable in a fixed position against the surface on the portion of the bottle; and the at least one attachment body is fixedly positionable in the fixed position independently of the support body and independently of gravitational forces on the bottle.

29. The system of claim 28 wherein the interface body comprises a threaded body coupled to the at least one attachment body and rotatable to position the at least one attachment body in the fixed position.

30. The system of claim 24 wherein the support body comprises at least one actuator, and wherein when the interface body is attached to the support body, the at least one actuator is actuatable to move the retaining body to the retracted position to detach the interface body from the support body while the interface body remains attached to the portion of the bottle.

* * * * *